US010568364B2

(12) United States Patent
Villarreal

(10) Patent No.: US 10,568,364 B2
(45) Date of Patent: Feb. 25, 2020

(54) BABY SLEEPING GARMENT

(71) Applicant: S & M TRADING PTY LTD, Lower Templestowe (AU)

(72) Inventor: Lourdes Villarreal, Lower Templestowe (AU)

(73) Assignee: S & M TRADING PTY LTD (AU)

( * ) Notice: Subject to any disclaimer, the term of this patent is extended or adjusted under 35 U.S.C. 154(b) by 367 days.

(21) Appl. No.: 15/372,940

(22) Filed: Dec. 8, 2016

(65) Prior Publication Data

US 2017/0224025 A1 Aug. 10, 2017

(30) Foreign Application Priority Data

Feb. 10, 2016 (AU) ..... 2016900452

(51) Int. Cl.
*A41D 13/00* (2006.01)
*A41B 13/06* (2006.01)

(52) U.S. Cl.
CPC ..... *A41B 13/06* (2013.01); *A41B 2300/30* (2013.01); *A41B 2300/32* (2013.01); *A41B 2300/322* (2013.01); *A41B 2300/324* (2013.01); *A41B 2300/326* (2013.01); *A41B 2400/44* (2013.01)

(58) Field of Classification Search
CPC ..... A41B 13/06; A41B 13/103; A41B 13/106; A41B 13/10; A41B 13/08
USPC ..... 2/69.5
See application file for complete search history.

(56) References Cited

U.S. PATENT DOCUMENTS

| | | | | |
|---|---|---|---|---|
| 3,493,972 | A * | 2/1970 | Oldham | B63C 9/087 2/2.17 |
| 3,555,567 | A * | 1/1971 | Owen | A41B 13/005 2/69.5 |
| 4,862,517 | A * | 9/1989 | Meistrell | B63C 11/04 2/2.17 |
| 9,204,673 | B1 * | 12/2015 | Alperin | A47G 9/083 |
| 2011/0180079 | A1 * | 7/2011 | Krawchuk | A41B 13/06 128/873 |
| 2014/0033395 | A1 * | 2/2014 | Torgersen | A47G 9/083 2/69.5 |
| 2014/0068834 | A1 * | 3/2014 | Skinner | A41B 13/06 2/69.5 |

* cited by examiner

*Primary Examiner* — Timothy K Trieu
(74) *Attorney, Agent, or Firm* — Lerner, David, Littenberg, Krumholz & Mentlik, LLP

(57) ABSTRACT

Described embodiments relate to a garment for a baby or infant, the garment comprising a neck opening; two enclosed arm portions configured to each receive an arm of a wearer of the garment, each arm portion sized to allow the wearer to straighten their arm within the arm portion; a waist portion being of a reduced width compared to the width of the garment across the arm portions; a single enclosed leg portion, the leg portion being wider than the waist portion and sized to accommodate two legs of the wearer; and at least one closure. The at least one closure allows for fastening and unfastening of the garment at the neck opening and, independently of the neck opening, at the leg portion.

18 Claims, 7 Drawing Sheets

BABY SLEEPING GARMENT

CROSS-REFERENCE TO RELATED APPLICATION

The present application claims priority from Australian Patent Application No. 2016900452 filed Feb. 10, 2016, the disclosure of which is hereby incorporated herein by reference.

BACKGROUND OF THE INVENTION

Described embodiments generally relate to garments for babies and infants. In particular, described embodiments are directed to sleeping garments for babies and infants.

While babies and infants are in a REM state of sleep, they will often experience twitches and jerks, which are known as the startle reflex, or the moro reflex. This may cause the child to flail their arms sidewards and/or upwards before bringing their arms in to their chest in the foetal position. If the child is falling asleep when a startle reflex occurs, they may be caused to wake up.

In order to deal with this, babies are often swaddled or wrapped from birth until they grow out of the startle reflex. Babies and infants often find comfort in being swaddled or wrapped up, as it gives them a feeling of security and echoes the feeling of being in the womb. Many infants enjoy the security of being swaddled long after they have grown out of the startle reflex. However, swaddling infants as they grow older becomes more difficult and dangerous. Children develop the ability to escape the swaddling, leaving them uncovered, or tangled in the swaddling cloths. Alternatively, infants are at risk of suffocation if they roll over onto their stomachs while swaddled.

It is desired to address or ameliorate one or more shortcomings or disadvantages associated with prior baby garments, or to at least provide a useful alternative thereto.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF SUMMARY OF THE INVENTION

Some embodiments relate to a garment for a baby or infant, the garment comprising:

a neck opening;

two enclosed arm portions configured to each receive an arm of a wearer of the garment, each arm portion sized to allow the wearer to straighten their arm within the arm portion;

a waist portion being of a reduced width compared to the width of the garment across the arm portions;

a single enclosed leg portion, the leg portion being wider than the waist portion and sized to accommodate two legs of the wearer; and at least one closure;

wherein the at least one closure allows for fastening and unfastening of the garment at the neck opening and, independently of the neck opening, at the leg portion.

According to some embodiments, the garment encloses the wearer from the neck down. According to some embodiments, the arm portions are sized to provide a slight resistance to the arms of the wearer of the garment when the wearer straightens their arms.

According to some embodiments, the closure comprises a zipper. According to some embodiments, the closure comprises a double ended zipper. According to some embodiments, the closure comprises at least one of Velcro, snaps, buttons, toggles, hooks and eyes.

According to some embodiments, the closure extends between the neck opening and a bottom of the garment. According to some embodiments, the closure is positioned to extend from the neck opening, diagonally to a side of the garment at the waist portion, down the side of the garment from the waist portion to the leg portion, and across the bottom of the leg portion According to some embodiments, the garment further comprises a closure cover adjacent the neck opening, configured to extend around the closure and protect the wearer of the garment from contact with the closure.

According to some embodiments, the leg portion is be shaped and sized to accommodate a wearer wearing a hip dysplasia harness beneath the garment.

According to some embodiments, the garment further comprises a protective flap on the inside of the garment to provide a barrier between the skin of the wearer of the garment and the closure. According to some embodiments, the protective flap is positioned to extend between the neck opening of the garment and the bottom of the garment. According to some embodiments, the protective flap is arranged to cover the entirety of the closure from the inside of the garment.

According to some embodiments, the width of the garment across the arm portions is between 80% and 90% of the length of garment from the neck opening to the bottom of the leg portion. According to some embodiments, the width of the garment across the arm portions is between 85% and 88% of the length of garment from the neck opening to the bottom of the leg portion.

According to some embodiments, the width of the garment across the arm portions may be around 56 cm, around 65 cm, or around 75 cm. According to some embodiments, the length of garment from the neck opening to the bottom of the leg portion is around 65 cm, around 75 cm or around 86 cm. According to some embodiments, the diameter of the neck opening may be around 11 cm, around 13 cm or around 14 cm.

BRIEF DESCRIPTION OF THE DRAWINGS

Embodiments are described in further detail below, by way of example and with reference to the accompanying drawings, in which.

DETAILED DESCRIPTION

Described embodiments generally relate to garments for babies and infants. In particular, described embodiments are directed to sleeping garments for babies and infants.

Figure 1:
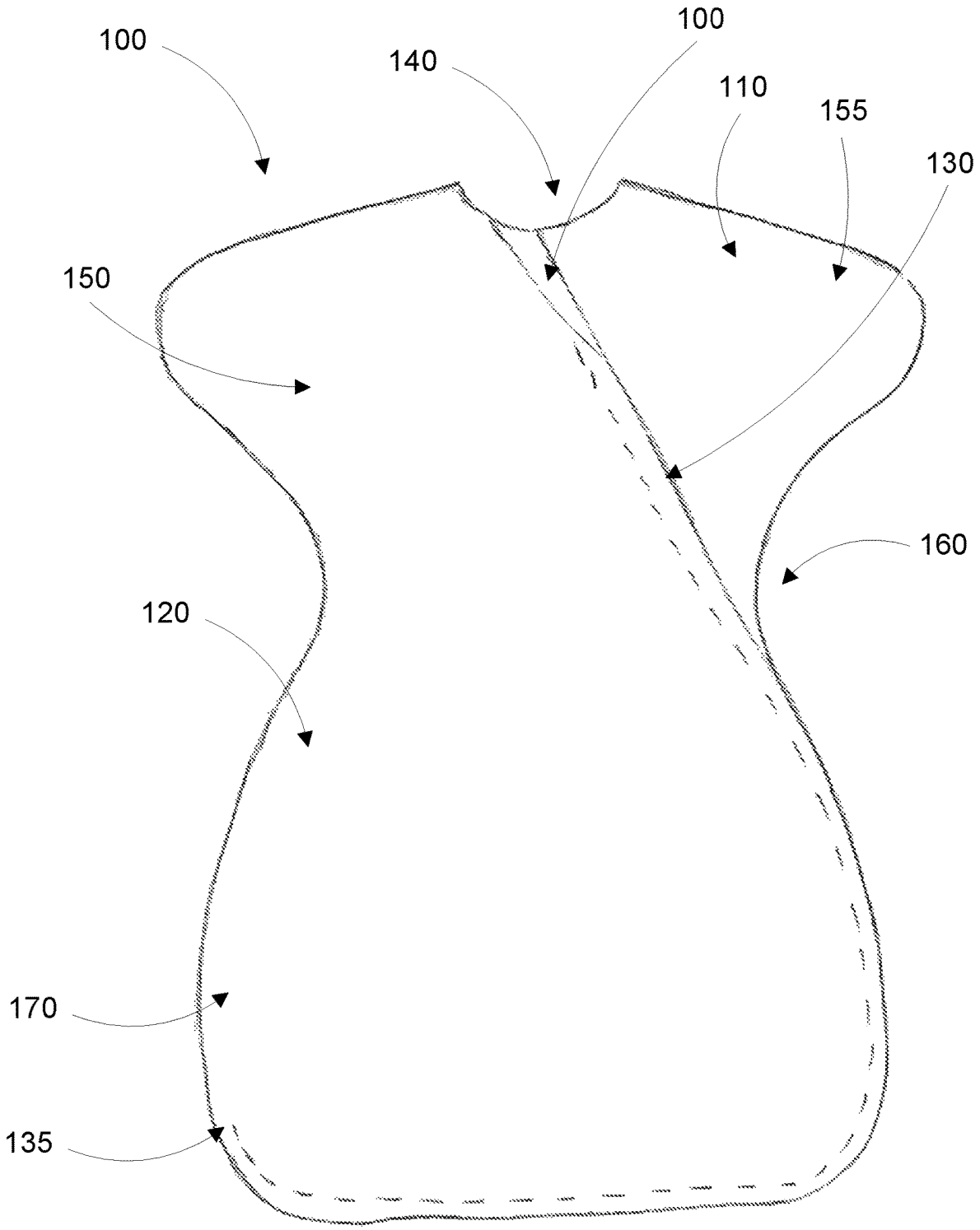
FIG. 1 shows a front view of a garment according to some embodiments.

FIG. 1 shows a front view of garment 100. Garment 100 may be used as a baby or infant sleep garment designed to help babies and infants transition away from being swaddle wrapped, helping babies and infants to cope better with the 'startle reflex' and helping them to sleep better and longer. Garment 100 may allow the wearer to move their arms freely, while still providing an enclosed, secure feeling. This allows the baby to roll over onto their stomach and support themselves with their arms, reducing the risk of suffocation. Garment 100 may be a sleep suit that encloses the wearer from the neck down, and provides a slight resistance to the movement of their arms, allowing them to feel secure, even if they have a startle reflex.

The front of garment 100 is made up of a yoke portion 110 and a body portion 120. Yoke portion 110 is attached to body portion 120 by a closure 130, which may include a zipper in some embodiments. The zipper may be a double ended zipper in some embodiments, able to be opened from either end. In some embodiments, closure 130 may additionally or alternatively include one or more buttons, snaps, toggles, hooks, eyes, strips of Velcro, or other closure means. Closure 130 may be positioned to extend between a neck opening 140 of garment 100 and a bottom closure opening 135 of garment 100. Closure 130 may include a cover 137 adjacent to neck opening 140 to extend around the closure and protect the wearer of garment 100 from contact with closure 130.

Garment 100 may include two oppositely disposed arm portions 150, 155, a waist portion 160, and a leg portion 170 disposed at an opposite end of the garment from the neck opening 140. Arm portions 150, 155 may extend laterally on each side of the neck opening 140 and may each be designed to contain an arm and a hand of the wearer of garment 100, allowing the wearer to move their arms freely but providing slight resistance in the movement of their arms. Arm portions 150, 155 may be of a length to just allow the wearer to straighten their arms fully, but to feel a resistance from the ends of arm portions 150, 155 when they do this. Arm portions 150, 155 may be enclosed so that there is no opening for a wearer's hand to extend through, which may prevent the wearer from being able to scratch themselves with their fingernails. Waist portion 160 may be of a reduced width compared to the width of the garment across the arm portions 150, 150, and may be designed to be adjacent to the waist of the wearer of garment 100. Leg portion 170 may be designed to contain the legs of the wearer of garment 100. Leg portion 170 may be designed to contain both legs of the wearer in a single enclosed space. Garment 100 may have only one unitary leg portion 100. Leg portion 170 may be of a larger width than waist portion 160, and may be shaped and sized to accommodate a wearer wearing a hip dysplasia harness beneath garment 100.

In some embodiments, bottom closure opening 135 may be positioned on the side of leg portion 170 of garment 100. In some embodiments, closure 130 may be positioned to extend from neck opening 140, diagonally to a side of garment 100 at waist portion 160, down the side of garment 100 from waist portion 160 to leg portion 170, and across the bottom of leg portion 170 to end at bottom closure opening 135. This configuration may allow for closure 130 at the bottom of leg portion 170 of garment 100 to be opened to allow access to the legs of the wearer of garment 100 without opening the upper portion of closure 130 at the neck and chest of the wearer.

Figure 2:
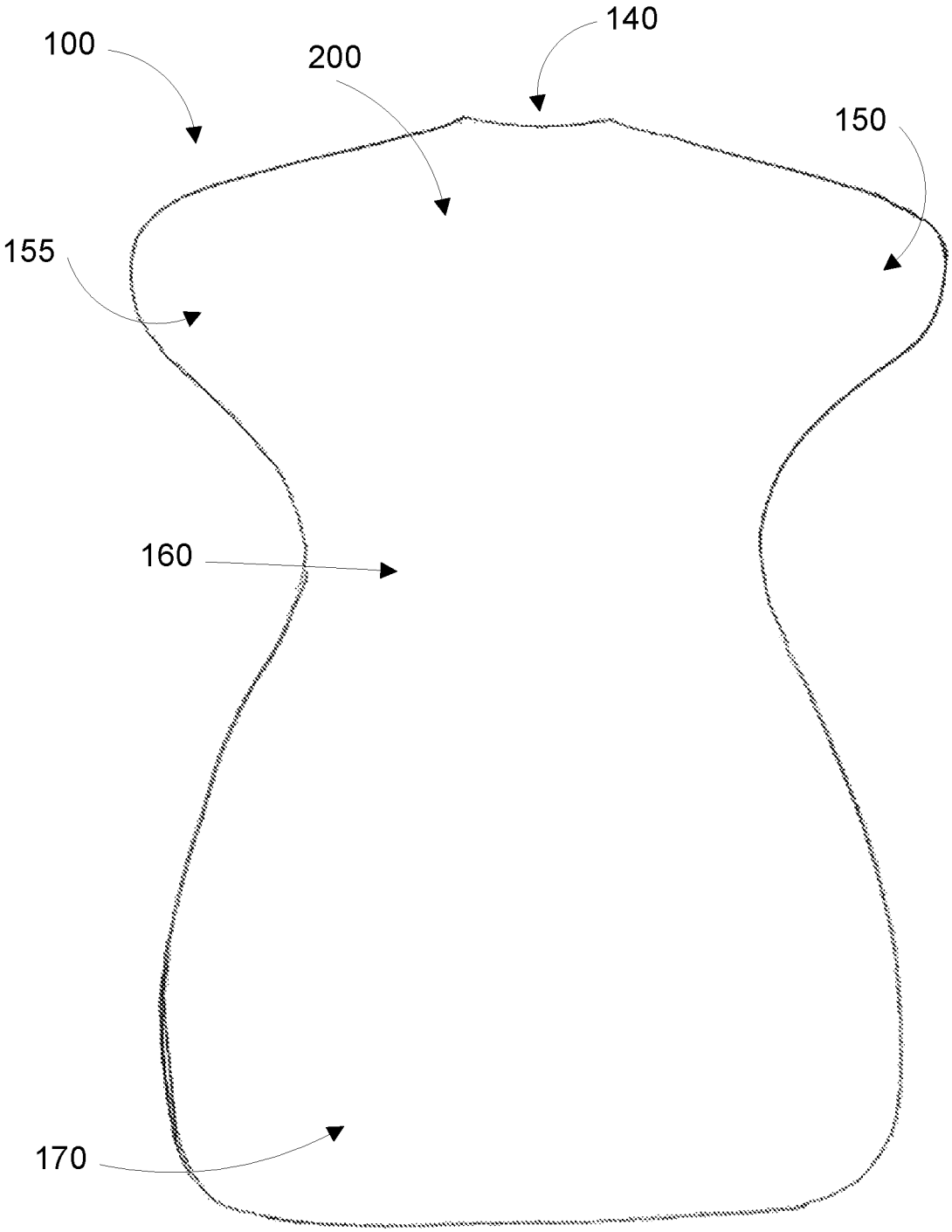
FIG. 2 shows a back view of a garment according to some embodiments.

FIG. 2 shows a back view of garment 100. The back of garment 100 includes a back portion 200. Back portion 200 has a neck opening 140, two arm portions 150, 155, a waist portion 160, and a leg portion 170. Arm portions 150, 155 may each be designed to contain an arm and a hand of the wearer of garment 100, without restricting the arm position of the wearer. Arm portions 150, 155 may be enclosed so that there is no opening for a wearer's hand to extend through. Waist portion 160 may be of a smaller width than arm portion 160, and may be designed to be adjacent to the waist of the wearer of garment 100. Leg portion 170 may be designed to contain the legs of the wearer of garment 100. Leg portion 170 may be designed to contain both legs of the wearer in a single enclosed space.

Figure 3:
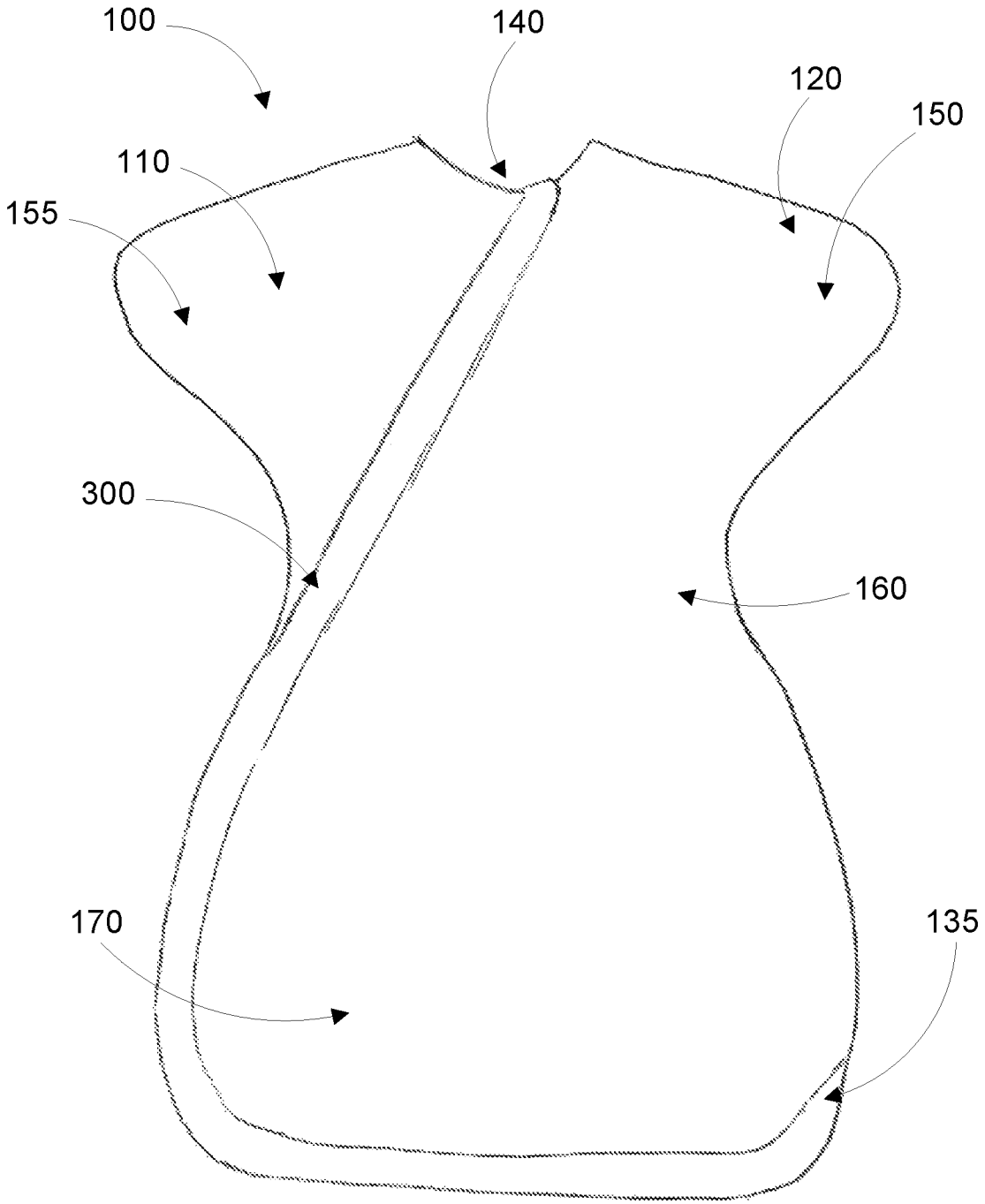
FIG. 3 shows an inside view of the front of a garment according to some embodiments.

FIG. 3 shows the inside view of the front of garment 100. A protective flap 300 is attached to the inside of body portion 120 to provide a barrier between the skin of the wearer of garment 100 and closure 130. Protective flap 300 may be positioned to extend between the neck opening 140 of garment 100 and the bottom closure opening 135 of garment 100, running along the full length of closure 130.

Figure 4:
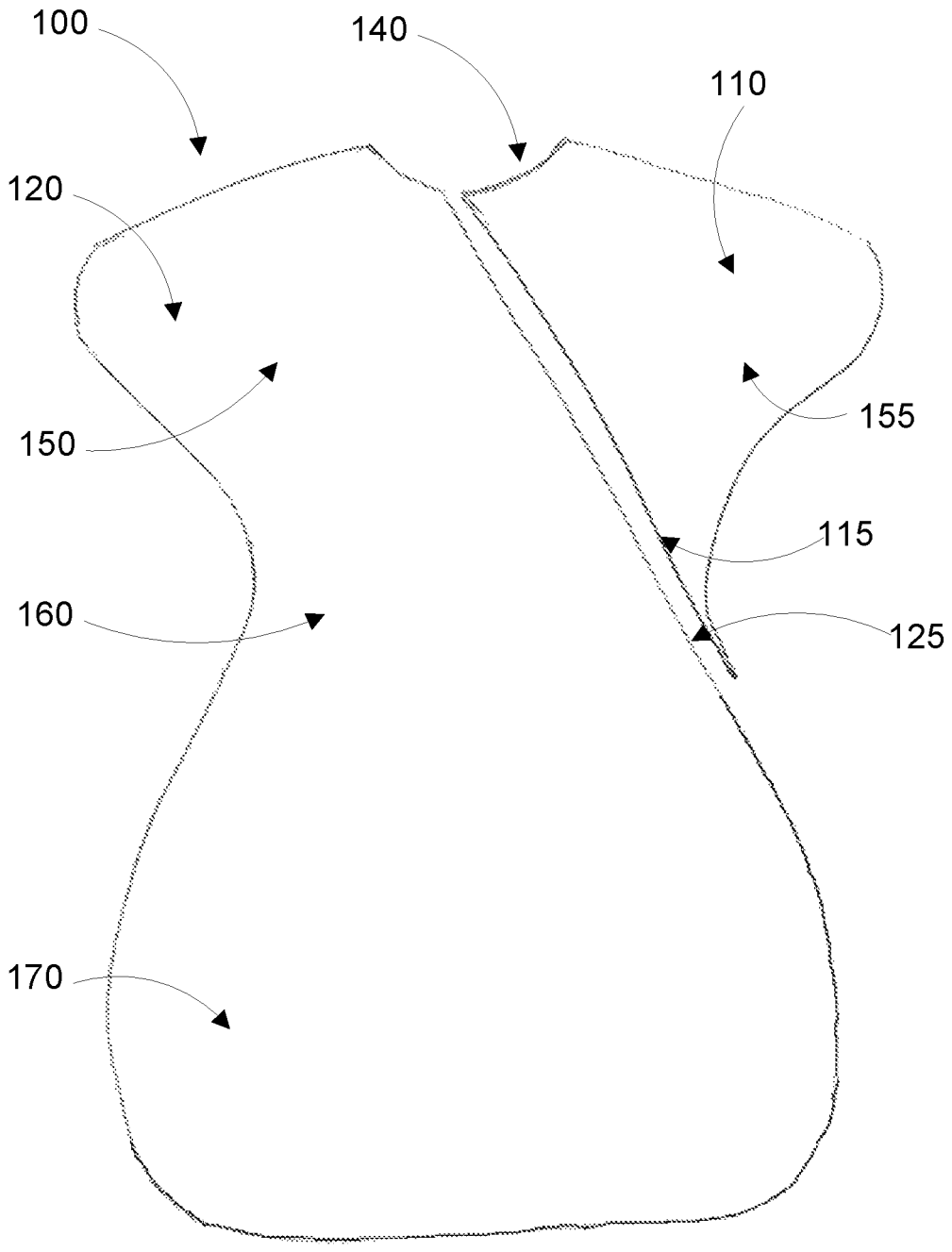
FIG. 4 shows a flat layout of some components of a garment according to some embodiments.

FIG. 4 shows a diagram of yoke portion 110 and a body portion 120 positioned side by side. Yoke portion 110 has a closure edge 115 to which closure 130 may be attached. Body portion 120 has a complementary closure edge 125 to which closure 130 may be attached, to allow yoke portion 110 and body portion 120 to be attached to one another and for garment 100 to be fastened and unfastened.

Figure 5:
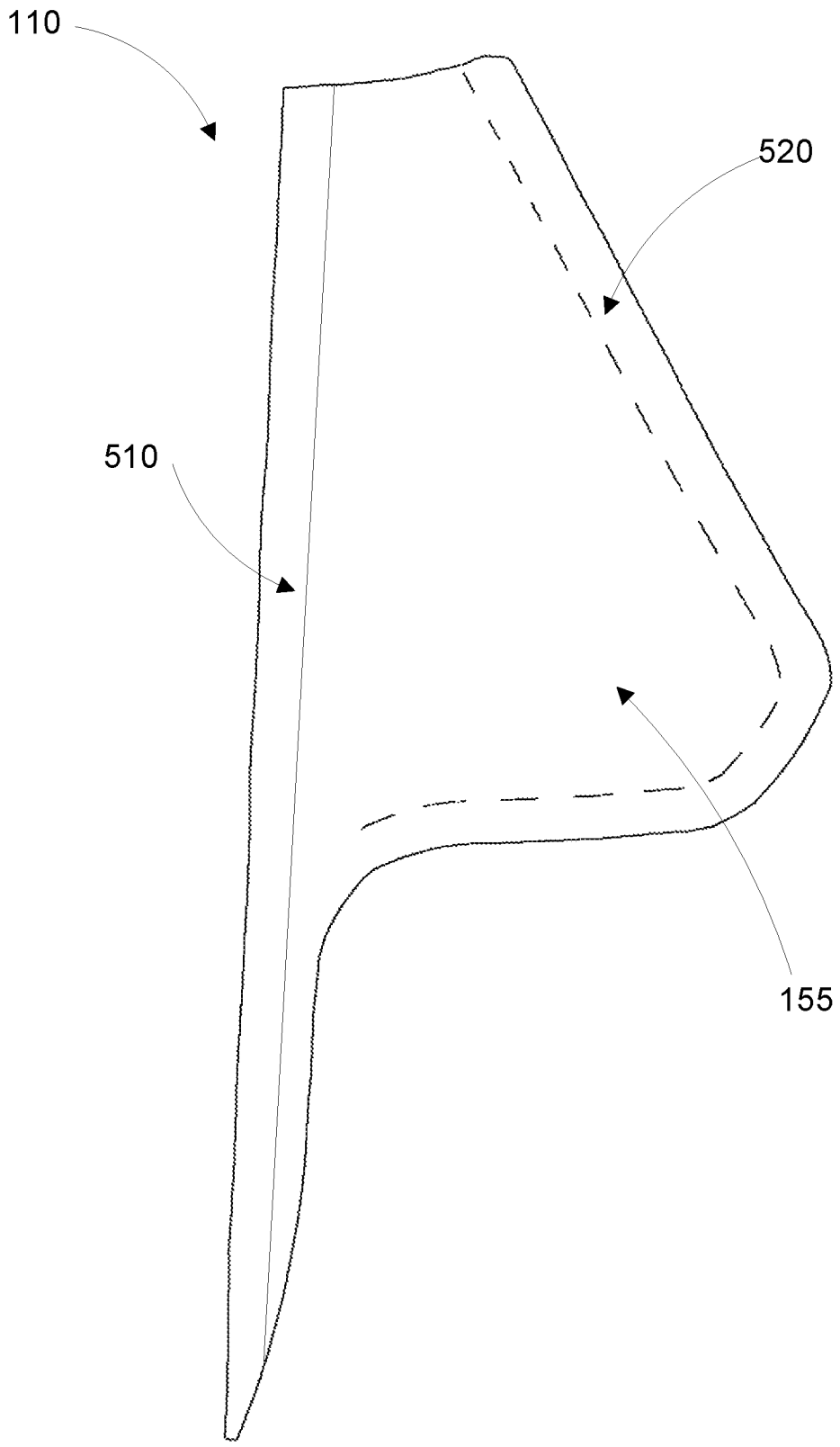
FIG. 5 shows a flat pattern layout of a yoke component of a garment according to some embodiments.

FIG. 5 shows a flat pattern view of yoke portion 110, which forms arm portion 155 of garment 100. Yoke portion 110 has a seam allowance 520 for attaching yoke portion 110 to back portion 200. Yoke portion 110 may be attached to back portion 200 by stitching, gluing, or by other attachment means. Yoke portion 110 also has a closure attachment line 510 designating where closure 130 is to be attached to yoke portion 110. Yoke portion 110 may be attached to closure 130 by stitching, gluing, or by other attachment means.

Figure 6:
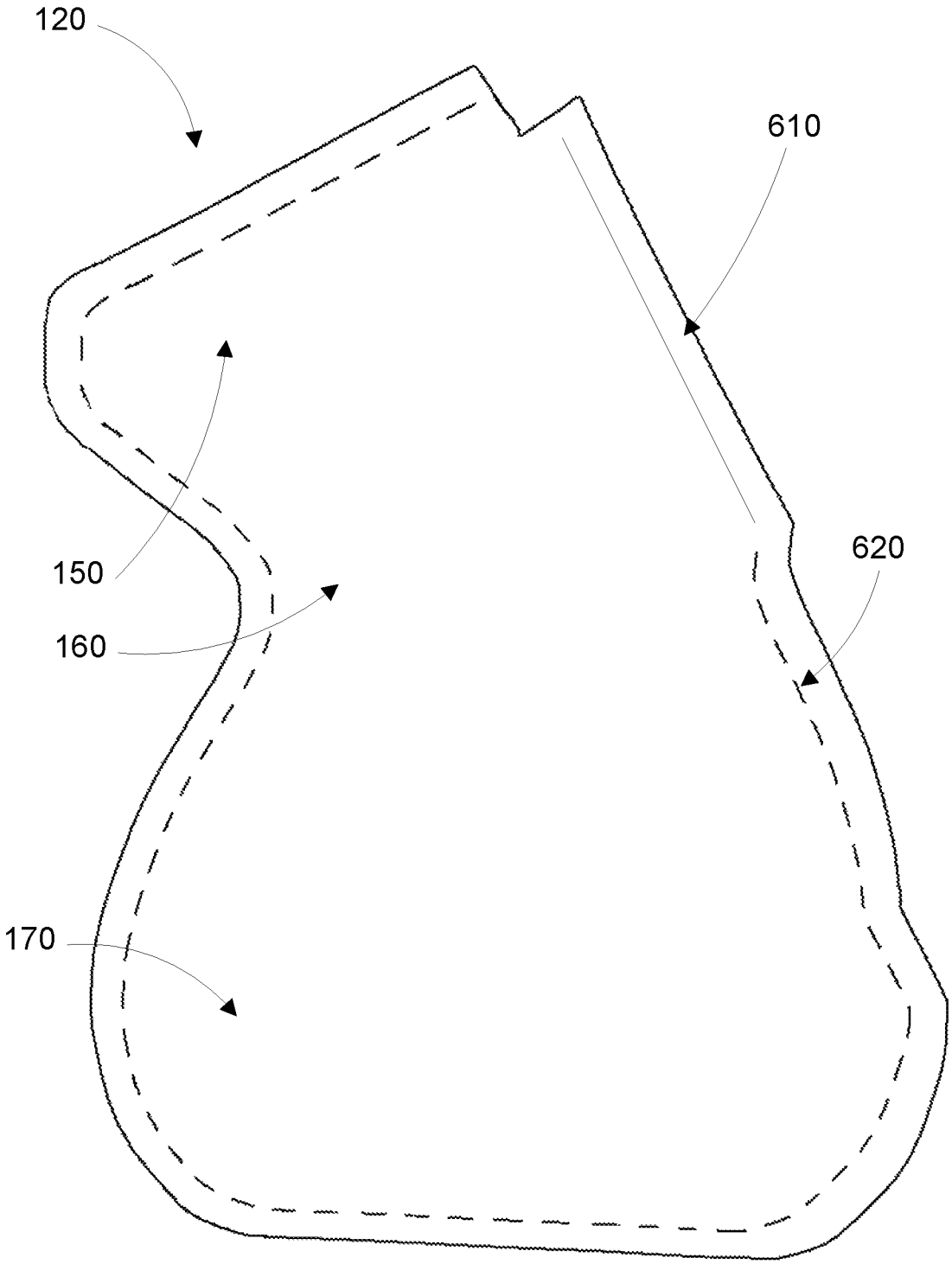
FIG. 6 shows a flat pattern layout of a front component of a garment according to some embodiments.

FIG. 6 shows a flat pattern view of body portion 120, which forms arm portion 150, waist portion 160, and leg portion 170 of garment 100. Yoke portion 110 has a seam allowance 620 for attaching body portion 120 to back portion 200. Body portion 120 may be attached to back portion 200 by stitching, gluing, or by other attachment means. Body portion 120 also has a closure attachment line 610 designating where closure 130 is to be attached to body portion 120. Body portion 120 may be attached to closure 130 by stitching, gluing, or by other attachment means.

Figure 7:
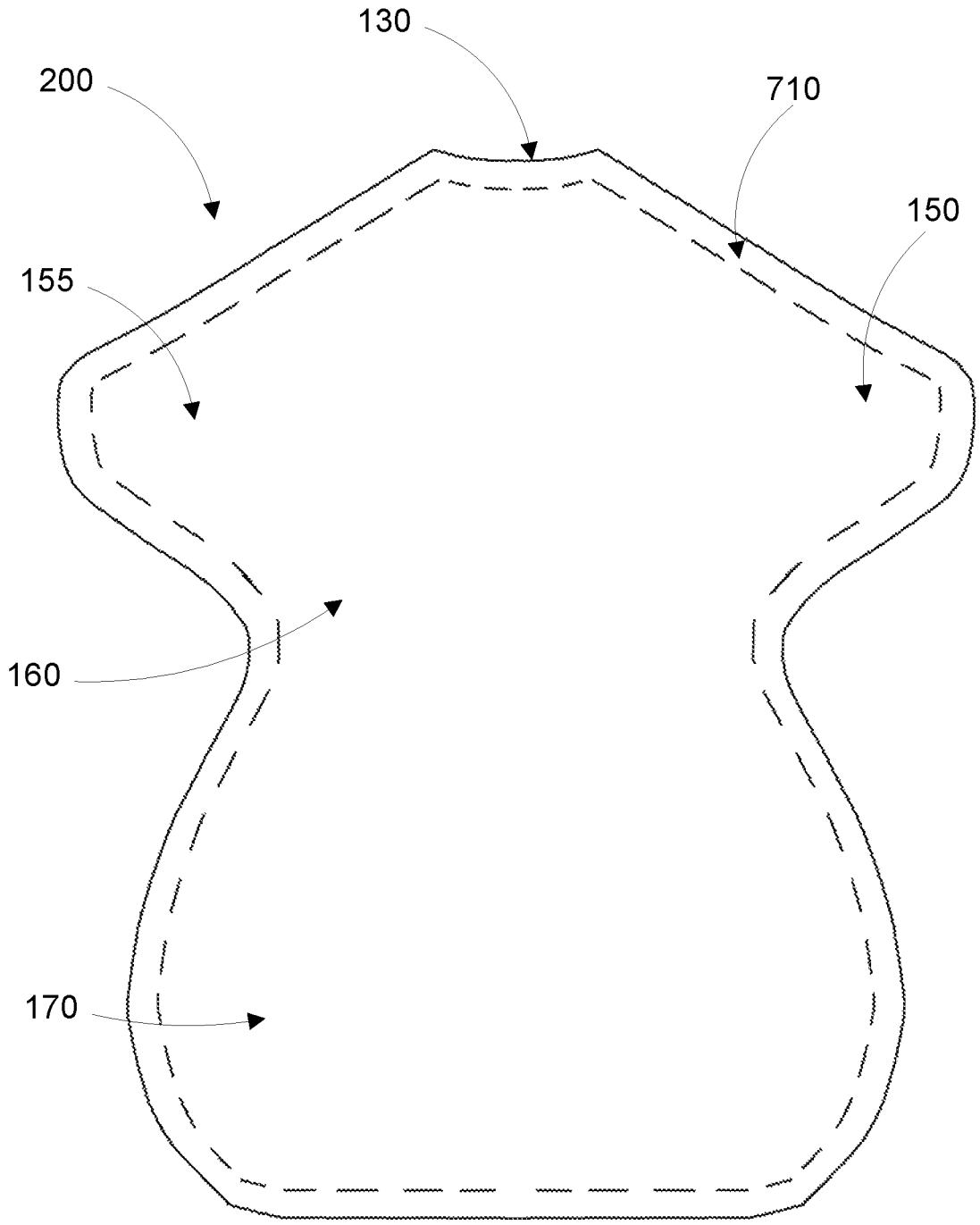
FIG. 7 shows a flat pattern layout of a back component of a garment according to some embodiments.

FIG. 7 shows a flat pattern view of back portion 200, which forms arm portions 150, 155, waist portion 160, and leg portion 170 of garment 100. Back portion 200 has a seam allowance 710 for attaching back portion 200 to yoke portion 110 and body portion 120. Back portion 200 may be attached to yoke portion 110 and body portion 120 by stitching, gluing, or by other attachment means.

Garment 100 may be made in a variety of materials, such as cotton, fleece, or jersey. In some embodiments, garment 100 may be made of a natural fibre material. In some embodiments, garment 100 may be made of a breathable material. Garment 100 may be made in a number of different sizes to suit children of different ages and body shapes. In some embodiments, the total width of arm portions 150 and 155 may be between 80% and 90% of the length of garment 100 from neck opening 140 to the bottom of leg portion 170. In some embodiments, the total width of arm portions 150 and 155 may be between 85% and 88% of the length of garment 100 from neck opening 140 to the bottom of leg portion 170.

In some embodiments, garment 100 may be made in a "small" size to suit babies between 3 and 6 months old, having an average weight of 18 pounds. In the small size, the total width of arm portions 150 and 155 may be around 56 cm, and the length of garment 100 from neck opening 140 to the bottom of leg portion 170 may be around 65 cm. Neck opening 140 may be around 11 cm in diameter.

In some embodiments, garment 100 may be made in a "medium" size to suit babies between 6 and 12 months old, having an average weight above 18 pounds. In the medium size, the total width of arm portions 150 and 155 may be around 65 cm, and the length of garment 100 from neck opening 140 to the bottom of leg portion 170 may be around 75 cm. Neck opening 140 may be around 13 cm in diameter.

In some embodiments, garment 100 may be made in a "large" size to suit babies over 12 months old. In the large size, the total width of arm portions 150 and 155 may be around 75 cm, and the length of garment 100 from neck opening 140 to the bottom of leg portion 170 may be around 86 cm. Neck opening 140 may be around 14 cm in diameter. The large size may be provide less arm resistance to the wearer of garment 100 than the small and medium sizes.

In some embodiments, garment 100 may include one or more slots (not shown) in the front and back sections of leg portion 170 to allow a safety belt strap to be passed through garment 100. This may allow a safety belt to be passed between the legs of a wearer of garment 100, to allow them to be secured into a car seat, baby carrier, or another harness-like arrangement.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A garment for a baby or infant, the garment comprising:
a neck opening;
two enclosed arm portions configured to each receive an arm of a wearer of the garment, each arm portion sized to allow the wearer to straighten their arm laterally within the arm portion;
a waist portion being of a reduced width compared to the width of the garment across the arm portions;
a single enclosed leg portion, the leg portion being wider than the waist portion and sized to accommodate two legs of the wearer; and
at least one closure positioned to extend from the neck opening continually and diagonally to a side of the garment at the waist portion, down the side of the garment from the waist portion to the leg portion, and across the bottom of the leg portion;
wherein the at least one closure comprises at least one fastener; said at least one fastener configured to allows the garment at the neck opening to be fastened and unfastened while the garment at the leg portion remains fastened, and the garment at the leg portion to be fastened and unfastened while the garment at the neck opening remains fastened.

2. The garment of claim 1, wherein the garment encloses the wearer from the neck down.

3. The garment of claim 2, wherein the arm portions are sized to provide a slight resistance to the arms of the wearer of the garment when the wearer straightens their arms.

4. The garment of claim 1, wherein the closure comprises a zipper.

5. The garment of claim 4, wherein the closure comprises a double ended zipper.

6. The garment of claim 1, wherein the closure comprises at least one of Velcro, snaps, buttons, toggles, hooks and eyes.

7. The garment of claim 1, wherein the closure extends between the neck opening and a bottom of the garment.

8. The garment of claim 1, wherein the garment further comprises a closure cover adjacent the neck opening, configured to extend around the closure and protect the wearer of the garment from contact with the closure.

9. The garment of claim 1, wherein the leg portion is shaped and sized to accommodate a wearer wearing a hip dysplasia harness beneath the garment.

10. The garment of claim 1, wherein the garment further comprises a protective flap on the inside of the garment to provide a barrier between the skin of the wearer of the garment and the closure.

11. The garment of claim 10, wherein the protective flap is positioned to extend between the neck opening of the garment and the bottom of the garment.

12. The garment of claim 10, wherein the protective flap is arranged to cover the entirety of the closure from the inside of the garment.

13. The garment of claim 1, wherein the width of the garment across the arm portions is between 80% and 90% of the length of garment from the neck opening to the bottom of the leg portion.

14. The garment of claim 1, wherein the width of the garment across the arm portions is between 85% and 88% of the length of garment from the neck opening to the bottom of the leg portion.

15. The garment of claim 1, wherein the width of the garment across the arm portions may be around 56 cm, around 65 cm, or around 75 cm.

16. The garment of claim 1, wherein the length of garment from the neck opening to the bottom of the leg portion is around 65 cm, around 75 cm or around 86 cm.

17. The garment of claim 1, wherein the diameter of the neck opening is around 11 cm, around 13 cm or around 14 cm.

18. The garment of claim 1, wherein the arm portions are sized to provide a slight resistance to the arms of the wearer of the garment when the wearer straightens their arms.

* * * * *